US006458270B1

(12) United States Patent
Watson et al.

(10) Patent No.: US 6,458,270 B1
(45) Date of Patent: Oct. 1, 2002

(54) SWIMMING POOL SKIMMER DUCT JOINT

(76) Inventors: Paul Watson, 66 Vermilion Way, Levittown, PA (US) 19054; Americo Calderone, 21 Buttonwood La., Levittown, PA (US) 19054

( * ) Notice: Subject to any disclaimer, the term of this patent is extended or adjusted under 35 U.S.C. 154(b) by 0 days.

(21) Appl. No.: 09/797,586

(22) Filed: Mar. 5, 2001

(51) Int. Cl.[7] ..... E04H 4/12; E04H 4/16
(52) U.S. Cl. ..... 210/169; 210/232; 4/507
(58) Field of Search ..... 210/169, 232; 4/490, 507

(56) References Cited

U.S. PATENT DOCUMENTS 4,454,035 A * 6/1984 Stefan
4,903,351 A * 2/1990 Dengel et al.
5,059,314 A * 10/1991 Beckman
6,214,217 B1 * 4/2001 Sliger, Jr.

FOREIGN PATENT DOCUMENTS

FR 2736344 * 1/1997

* cited by examiner

*Primary Examiner*—Duane Smith
*Assistant Examiner*—Fred Prince
(74) *Attorney, Agent, or Firm*—Gregory J. Gore

(57) ABSTRACT

A flange joint that fully isolates the steel sidewall from contact with water entering the skimmer duct of an above-ground pool is provided by the use of a pair of mating flanges fitted to opposite sides of the sidewall. The flanges are comprised of two closely interfitting elements sealed together directly to the metal sidewall by a water-proof adhesive. The flanges include overlapping collars within the sidewall opening which completely seal off and isolate water entering the skimmer duct to prevent any possibility of contact with the metal pool sidewall. Thus, water damage to the pool sidewall is eliminated.

6 Claims, 2 Drawing Sheets

SWIMMING POOL SKIMMER DUCT JOINT

FIELD OF THE INVENTION

The present invention relates to aboveground swimming pool construction and more particularly to the mounting of the surface skimmer unit to the sidewall of the pool.

BACKGROUND OF THE INVENTION

Aboveground swimming pools are becoming ever increasingly popular because they are low cost, provide ease of maintenance and are not permanent structures. Typically, the pools are comprised of a substantially cylindrical perimeter formed of sheet steel with a water-proof liner in the middle. By design, the water is kept from contact with the steel sidewall by the liner and there are very few points in the pool construction where water is allowed to possibly come in contact with the steel. However, this unfortunately occurs in the area of the surface skimmer unit which is connected to the water filtration and circulation pump. By necessity, the skimmer unit must take water from the surface of the pool which must pass through an opening in the steel sidewall in order to enter the skimmer unit through a duct. The joint between the skimmer duct and the liner/sidewall is one of the few areas where water could possibly contact the steel sidewall, thus causing rust and corrosion.

To date, there has not been found a sufficient joint system for interconnecting the three elements of the pool liner, the sidewall, and the skimmer duct that avoids rust and corrosion of the steel sidewall around the area of the joint. Pool installers and work maintenance service contractors often find that the skimmer duct joint area causes the greatest maintenance problems. To cure a situation of excessive rust and corrosion, sometimes the entire sidewall section needs to be replaced. This can be a time-consuming and expensive repair. Therefore, there is a need in the art to create a skimmer duct joint which adequately protects the pool sidewall from the adverse effects of rust and corrosion which can occur from a direct contact between the water and the steel sidewall.

SUMMARY OF THE INVENTION

In order to solve the problem in the art described above, the present invention has been devised which provides a unique flange joint that fully isolates the steel sidewall from contact with water entering the skimmer duct. This is achieved by the use of a pair of mating flanges fitted to opposite sides of the sidewall that completely enclose the inside edges of the sidewall. The flanges are comprised of two closely inner-fitting elements sealed together directly to the metal sidewall by a water-proof adhesive. The flanges include overlapping collars within the sidewall opening which completely seal-off and isolate water entering the skimmer duct and prevent any possibility of contact with the metal pool sidewall. Thus, the above problems caused by water damage to the pool sidewall are eliminated.

More specifically, the applicant has devised a swimming pool skimmer duct joint comprising a pool liner, a sidewall and a skimmer duct affixed to the sidewall. The sidewall and pool liner have openings therein for a passage of pool surface water to enter the skimmer duct. The joint further comprises a first flange which is affixed against the outside of the pool sidewall, the flange has an inward projecting collar closely fitting around the inside circumference of an opening in the sidewall. The collar of the first flange extends a distance only equal to the thickness of the sidewall. A second flange affixed against the inside of the pool sidewall includes a second collar which fits closely within the first collar and extends through an opening of the first flange to a point flush with an outside surface of the first flange whereby the first and second collars form overlapping coverage of the inside edge of the sidewall opening. A water-proof adhesive is applied between all mating surfaces of the first and second flanges and the pool sidewall. The collars of flanges are designed such that an end of the first collar abuts a backside of the second flange, thus forming a standoff which holds the faces of the flanges apart a distance slightly greater than the thickness of the pool sidewall to allow for adhesive. The standoff also ensures that the end of the longer collar is held flush with the face of the opposing flange so that an unwanted overlapping lip is not formed that might trap water.

It is therefore the main object of the present invention to provide a water-proof joint around the circumference of the sidewall opening for the skimmer duct of an aboveground swimming pool which prevents all contact of the pool water and the sidewall. Further objects and advantages will become readily apparent from those of ordinary skill in the art from the following drawings and description of the preferred embodiment.

DESCRIPTION OF THE PREFERRED EMBODIMENT

Figure 1:
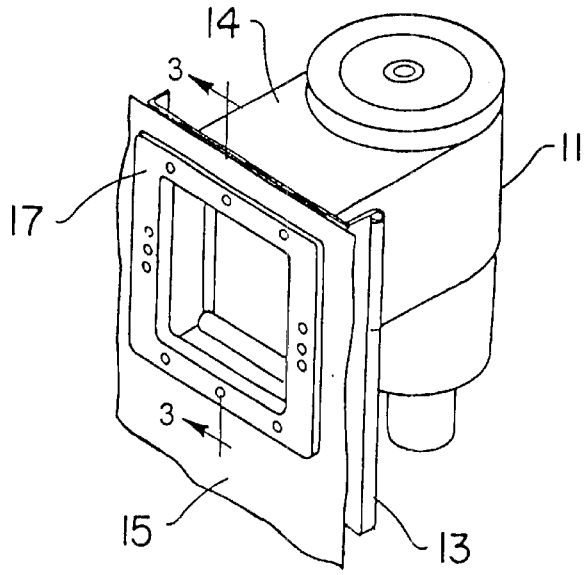
FIG. 1 is a top, right front perspective view of the environment of the present invention.

Referring now to FIG. 1, a typical aboveground swimming pool skimmer unit 11 is shown affixed to a section of the swimming pool sidewall 13. The water in the swimming pool is fully enclosed by a flaccid liner 15. Surface pool water enters the skimmer through a duct 14 which is clamped to the outside surface of the sidewall. Gasket 17 is applied against the inside surface of the pool liner and fasteners (not shown) secure this rigid gasket around the periphery of the skimmer duct to clamp the gasket, liner, sidewall, and skimmer unit together. This Figure is intended to show the background of the invention only. The flanges which comprise the present invention are not in view as they reside behind the pool liner.

Figure 2:
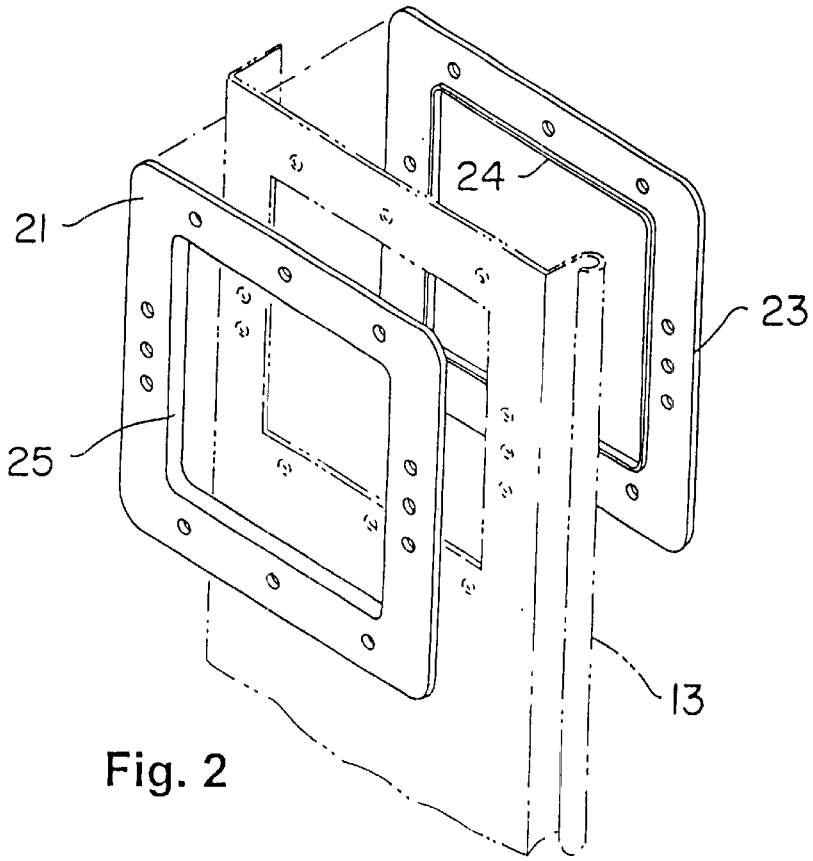
FIG. 2 is a top, right front perspective assembly view of the present invention.

Referring now to FIG. 2, the opening in the sidewall is enclosed by the use of mating flanges 21 and 23 of the present invention which comprise overlapping interior collars 24 and 25 . Pool sidewall 13 is captured between a first flange 21 facing interior to the pool area and directly contacting the back side of the pool liner and a second flange 23 on the opposite side of the pool sidewall which abuts the periphery of the pool skimmer duct. Both flanges include appropriate apertures to receive fasteners to provide the clamping attachment between the gasket and pool skimmer duct as shown in FIG. 1. Each flange includes a collar 24 and 25 which are closely inter-fitted when assembled. Greater detail of the overlapping collars which form the throat area between the first and second flanges 21 and 23 is shown in greater detail in FIGS. 3 and 4.

Figure 3:
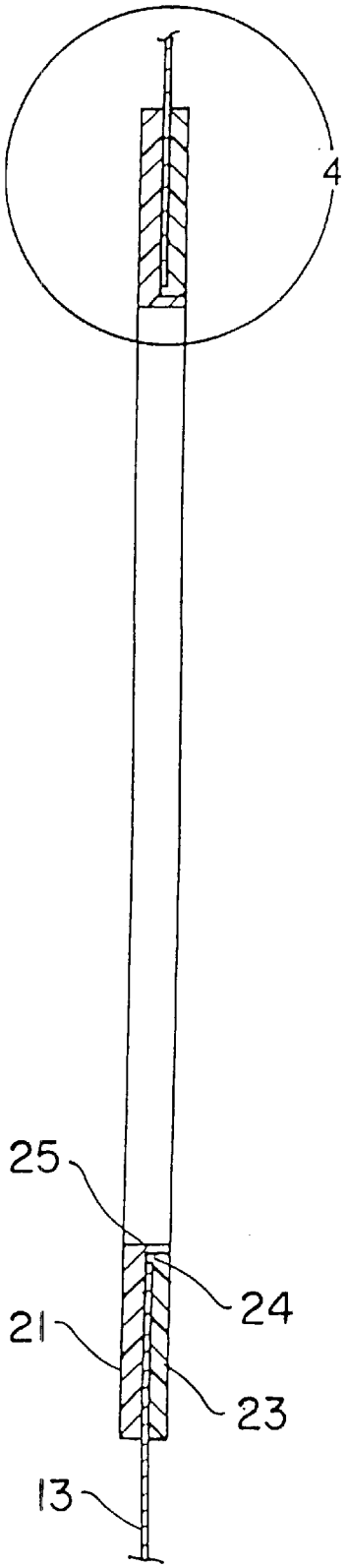
FIG. 3 is a side sectional view taken from FIG. 1 as shown in that Figure.
Figure 4:
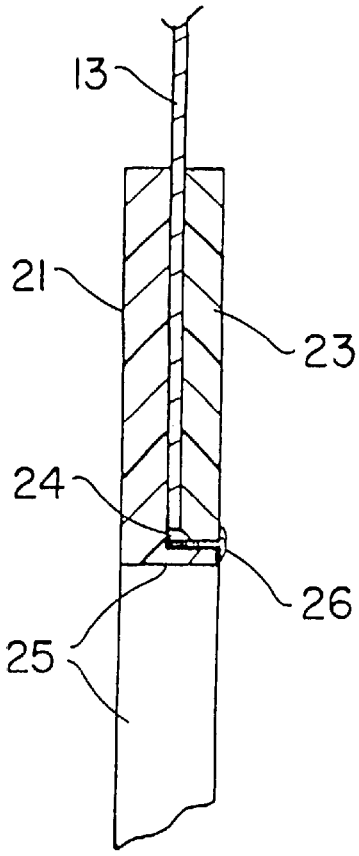
FIG. 4 is an enlarged view taken from FIG. 3.

Referring now to FIGS. 3 and 4, a side sectional view taken from FIG. 1 shows the first and second flanges 21 and 23 applied to the pool sidewall 13 as shown in the enlargement of this Figure. The first flange 21 includes a large collar 25 which extends the entire width of both mated flange pieces. The second flange 23 includes a collar 24 which is much shallower than collar 25 and just covers the interior edge of the pool sidewall. Collar 24 abuts a backside of the first flange and thus, also functions as a standoff to hold the collars apart a dimension chosen to be greater than the thickness of the sidewall allowing some additional clearance for the adhesive. An adhesive 26 is used between all adjacent parts to water-proof the joint. It can be readily seen from the enlarged view, FIG. 4, taken from a portion of FIG. 3 that the collars 24 and 25 of the flanges form overlapping, sealed barriers to prevent any possible contact of pool water with the pool sidewall around the edge of the skimmer opening. Therefore, by these mechanical relations, rusting and corrosion of the sidewall is substantially eliminated because contact with the pool water has been prevented.

From the foregoing drawings and the description of the preferred embodiment, it will be readily understood that the objectives of the present invention have been met. There may be obvious modifications and adaptations as required for a particular application of the invention; however, the invention should be limited in scope only by the following claims and their legal equivalents.

What is claimed is:

1. A swimming pool skimmer duct joint including in combination a pool side gasket, a pool liner, a sidewall and a skimmer duct affixed together, further comprising:

a first flange affixed against the outside of a pool sidewall, said flange having an inward projecting collar closely fitting around the inside circumference of an opening in said sidewall, said collar extending the distance substantially equal to the thickness of said sidewall; and a second flange affixed against the inside of said pool sidewall including a second collar, said second collar fitting closely within said inward projecting collar and extending through an opening in said first flange to a point flush with an outside surface of said first flange whereby said inward projecting and second collars form overlapping coverage of the inside edge of said sidewall opening.

2. The joint of claim 1 further including a water-proof adhesive applied between all mating services of said first and second flanges and said pool sidewall.

3. The joint of claim 2, wherein said pool liner is held directly against an inside-facing surface of said second flange.

4. The joint of claim 1, wherein an end of said inward projecting collar abuts a backside of said second flange.

5. The joint of claim 4, wherein said second collar extends to a point flush with said first flange.

6. A swimming pool skimmer duct joint, comprising:

an aboveground swimming pool having a pool liner, a sidewall and a skimmer duct affixed to said sidewall, said sidewall and said pool liner having openings therein for passage of pool surface water into said skimmer duct;

a first flange affixed against the outside of a pool sidewall, said flange having an inward projecting collar closely fitting around the inside edge of an opening in said sidewall, said collar extending a distance substantially equal to the thickness of said sidewall; and a second flange affixed against the inside of said pool sidewall including a second collar, said second collar fitting closely within said inward projecting collar and extending through an opening in said first flange to a point flush with an outside surface of said first flange whereby said inward projecting and second collars form overlapping coverage of the inside edge of said sidewall opening.

* * * * *